US008915983B2

(12) United States Patent
Broβmann et al.

(10) Patent No.: US 8,915,983 B2
(45) Date of Patent: Dec. 23, 2014

(54) RANGE EXTRACTOR HOOD

(71) Applicant: BSH Bosch und Siemens Hausgeräte GmbH, Munich (DE)

(72) Inventors: Anna Broβmann, München (DE); Julia Ehrensberger, München (DE); Andrzej Goczol, Niefern-Öschelbronn (DE); Michael Hegendörfer, Gröbenzell (DE); Robert Hibelt, Mering (DE); Thomas Kotlinski, München (DE); Daniel Metz, Karlsdorf-Neuthard (DE); Stefan Panten, Frankfurt (DE); Klaus-Heiner Rutsch, Aalen (DE); Ilka Schneider, München (DE); Julia Wellhausen, München (DE); Thomas Wilde, Karlsruhe (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 78 days.

(21) Appl. No.: 13/751,179

(22) Filed: Jan. 28, 2013

(65) Prior Publication Data

US 2013/0192182 A1 Aug. 1, 2013

(30) Foreign Application Priority Data

Feb. 1, 2012 (DE) ..... 10 2012 201 409

(51) Int. Cl.
*F24C 15/20* (2006.01)

(52) U.S. Cl.
CPC ..... *F24C 15/2035* (2013.01); *Y10S 55/36* (2013.01)
USPC ..... 55/385.1; 55/433; 55/493; 55/471; 55/472; 55/473; 55/DIG. 36; 96/415; 96/416; 126/299 D; 126/299 E; 126/299 F; 126/41 R; 454/63; 454/54; 454/65; 454/66; 454/67

(58) Field of Classification Search
USPC ..... 55/385.1, 433, 493, 471, 472, 473, 55/DIG. 36; 96/416, 415; 454/63, 64, 65, 454/66, 67; 126/299 D, 299 E, 299 F, 41 R
See application file for complete search history.

(56) References Cited

U.S. PATENT DOCUMENTS 2,528,844 A * 11/1950 Robertson ..... 126/299 D
2,621,755 A * 12/1952 Gray, Jr. ..... 55/433

(Continued)

FOREIGN PATENT DOCUMENTS

CN 2493868 Y 5/2002
DE 1190157 B 4/1965

(Continued)

OTHER PUBLICATIONS

National Search Report DE 10 2012 201 409.8 dated Oct. 31, 2012.

(Continued)

*Primary Examiner* — Christopher P Jones
*Assistant Examiner* — Minh-Chau Pham
(74) *Attorney, Agent, or Firm* — James E. Howard; Andre Pallapies

(57) ABSTRACT

A range extractor hood includes a screen, at least one filter element and at least one pivot bearing which swingably supports the at least one filter element on the screen. At least one locking member retains the at least one filter element to the screen. Located on the screen is a releasing device for, at least partially, releasing the locking member and retention of the filter element.

10 Claims, 2 Drawing Sheets

(56) References Cited

U.S. PATENT DOCUMENTS

| | | | | | |
|---|---|---|---|---|---|
| 2,624,405 | A | * | 1/1953 | Lynch | 160/353 |
| 2,862,437 | A | * | 12/1958 | Smith et al. | 126/299 D |
| 3,047,994 | A | * | 8/1962 | Le Brun | 55/493 |
| 3,500,740 | A | * | 3/1970 | Aubrey | 126/299 D |
| 3,520,115 | A | * | 7/1970 | Bowen | 55/422 |
| 3,660,969 | A | | 5/1972 | Fox | |
| 4,231,769 | A | | 11/1980 | Ahlrich | |
| 5,458,772 | A | * | 10/1995 | Eskes et al. | 210/238 |
| 5,566,667 | A | | 10/1996 | Cox | |
| 7,316,720 | B2 | * | 1/2008 | Cuppari et al. | 55/385.1 |
| 7,465,332 | B2 | * | 12/2008 | Randinelli | 55/524 |
| 8,490,614 | B1 | * | 7/2013 | Gregory | 126/41 R |
| 2013/0037017 | A1 | * | 2/2013 | Livchak et al. | 126/299 D |

FOREIGN PATENT DOCUMENTS

| | | | |
|---|---|---|---|
| DE | 9102590 | U1 | 4/1992 |
| DE | 10162951 | A1 | 5/2003 |
| DE | 102005008373 | A1 | 8/2006 |
| DE | 102008041495 | A1 | 3/2010 |
| EP | 0337935 | A1 | 10/1989 |
| EP | 1291584 | A2 | 3/2003 |
| EP | 1340944 | A2 | 9/2003 |
| EP | 1607686 | A1 | 12/2005 |
| EP | 2072906 | A2 | 6/2009 |
| GB | 1436710 | | 5/1976 |
| GB | 20139750 | A | 11/1984 |
| GB | 2229378 | A | 9/1990 |
| GB | 2249493 | A | 5/1992 |

OTHER PUBLICATIONS

European Search Report EP 13 15 1294 dated Jun. 19, 2013.
Report of Examination EP 13 15 1294 dated Oct. 13, 2014.

* cited by examiner

RANGE EXTRACTOR HOOD

BACKGROUND OF THE INVENTION

The invention relates to a range extractor hood.

At least one grease filter is provided on range extractor hoods which are usually used in kitchens. This filter has to be removed at regular intervals to be cleaned or to be replaced by a new filter.

It is known from the prior art for filter cartridges to be provided with a slide or twist handle. In this case two rods, for example, are displaced by sliding or twisting the handle strap provided on the twist handle. In the mounted position of the filter cartridge, the rods of the handle, together with in particular, stationary rods which are located on the side opposite to the bars of the handle on the filter or on the range extractor hood, retain the filter in its installed position. The sliding rods, and where applicable the stationary rods, are inserted into corresponding cut-outs in the range extractor hood. Locking devices are known which prevent the filter cartridge from falling out of the range extractor hood. Such a locking device is described for example in DE 101 62 921 A1. In this locking device a fastening element is attached to the twist handle via a strap that can be inserted into an opening in the range extractor hood and as a result the filter cartridge can also be retained in a tilted position with respect to the range extractor hood. The filter element is thus prevented from falling out.

A drawback of this locking device is that the user of the range extractor hood has to expend some effort in attaching this device to the appliance. In addition, releasing the locking device requires the hinged filter cartridge to be grasped from behind, which can be inconvenient for the user where the filter cartridges are severely soiled. The same applies when releasing the filter cartridge by operating the tilt handle.

BRIEF SUMMARY OF THE INVENTION

An object underlying the present invention is therefore to create a range extractor hood in which the filter can be safely and easily removed and, in particular, requires minimum interaction on the part of the user.

The invention is based on the knowledge that this object can be achieved by providing at least one release mechanism on the range extractor hood, which can be triggered from the screen of the range extractor hood.

According to the invention, the object is therefore achieved by a range extractor hood which includes a screen, at least one filter element, at least one pivot bearing swingably supporting the at least one filter element on the screen, at least one locking member retaining the at least one filter element to the screen; and a releasing device located on the screen for, at least partially, releasing the locking member and retention of the filter element.

In the context of the present invention, a range extractor hood means a fume extraction device which is preferably used in a kitchen for extracting and cleaning haze and vapor. Moreover, the range extractor hood includes a housing which, depending on the form of construction of the range extractor hood, can also be described as a chimney, in which a fan is mounted. Due to the fan, which can also be termed a blower, air is sucked into the housing and can be output from the range extractor hood via an air outlet. Underneath or in the lower area of the housing the range extractor hood has a screen, also termed a vapor shield or hood. A suction opening, via which the air can enter the housing, is provided in the screen. In some forms of construction the screen can be moved, at least partially, with respect to the housing of the range extractor hood. The suction opening is covered by a filter element which can also be termed a grease filter. Contaminants, in particular grease and liquids, are filtered out of the haze and vapor via the filter element. Preferably, a plurality of filter elements is provided on the range extractor hood. However, for clarity, reference is essentially made to only one filter element.

According to the invention, the filter element is retained on the screen by means of at least one pivot bearing and at least one locking means. If a plurality of filter elements is provided, than one pivot bearing and at least one locking means can be provided for each filter element. However, it is also possible to retain a plurality of filter elements on one pivot bearing and one locking means on the screen. A pivot bearing is also understood to mean an attachment which can also be described as a rotary bearing, and by means of which the filter element can be rotated about a pivot point or an axis of rotation with respect to the screen. The pivot bearing can, for example, be in the form of pins on the filter element which engage with corresponding recesses on the screen. According to the invention, other pivot bearings such as a strap on the screen for example, which engages with a recess on the filter element, are also possible. Preferably, the pivot bearing has a stop which limits the swing of the filter element to a predetermined angular range between the retained position of the filter element in the screen and a downwards tilted removal position. The retained position of the filter element is also termed the installed position.

In addition to the at least one pivot bearing, the filter element is additionally retained in the installed position on the screen by means of at least one locking means. The locking means is used to retain the filter element in the installed position against possible swivel motion about the pivot bearing. Moreover, the locking means can be provided on the filter element or on the screen. The locking means is a means that counteracts the gravitational force of the filter element. The locking means can be a mechanical and/or a magnetic means. The locking means can be, for example, a latching means that engages a notched recess. Alternatively, the locking means can be, for example, a magnet that retains the filter element on the screen. Finally, the locking means can also be a support on which at least one part of the filter element rests in the installed position. The locking means can be provided on the filter element on the side opposite to the pivot bearing. However, it is also possible for the locking means to engage with the same side of the filter element as the pivot bearing. This form of construction is possible in particular in a magnetic locking means or a support.

The range extractor hood is characterized in that it includes a releasing device for releasing, at least partially, the filter element retention. In the context of the present invention, the releasing device is a device by means of which the filter element retention is released at the screen in so far as said filter element is either still held via the pivot bearing on the screen or that the connection of the filter element with the screen, consisting of the locking means, can be released. In the first-mentioned case, the connection, consisting of the locking means and also described in the following as the locking device, is released, that is to say disengaged, by the releasing device. The releasing device can be a mechanical, electrical or magnetic device, for example.

According to the invention, the releasing device is located on the screen of the range extractor hood. In the context of the invention, if located on the screen, a releasing device is described as being provided in the screen or forming a part of the screen. In particular, a part of the releasing device which has to be actuated in order to initiate the releasing process, is located on the screen.

The inventive construction of the range extractor hood makes it possible to remove the filter element from the range extractor hood in a simple and reliable manner. In particular, due to the location of the releasing device on the screen, the filter can be of a particularly simple construction. In particular, no actuating element such as a sliding or lever handle on the filter element is necessary. In the simplest case, in order to remove the filter element from the range extractor hood, the user of the range extractor hood has only to remove the existing connection from the filter element to the screen via the pivot bearing. This can be effected by simple removal. Furthermore, since in addition to the locking means the filter is retained on the screen by the pivot bearing, uncontrolled fall-out can be prevented following release of the locking device.

According to one embodiment, the releasing device is actuated by movement of at least one part of the screen. The part of the screen that is moved for actuation of the releasing device can be a component part of the screen or a means located in the screen. Release of the filter element is further simplified by triggering the releasing device by moving a part of the screen. Preferably, the part of the screen which has to be moved in order to actuate the releasing device is located on the front side of the screen or forms at least one part of the front side of the screen. The screen, or at least its front side, faces the user of the range extractor hood and can therefore be easily reached by the user. In particular, in contrast to the filter element which is usually provided in the underside of the screen, the user can easily access the front side of the screen and thus initiate the filter replacement or removal processes.

According to one embodiment, the releasing device is located, at least partially, at a distance from the locking means. Preferably, the releasing device engages the locking means that is provided on the filter element, or at least acts upon said filter element. Due to the arrangement of the releasing device in the screen, at least one part of the releasing device can of course be located at a distance from the locking means. For example, at least one part of the releasing device can be located on the front side of the screen or on the rear side of the screen. As a result of this, the releasing device can be protected against contamination which occurs at the filter element, in particular grease or liquid deposits, or is at least less exposed to these.

According to one embodiment, the releasing device includes an operating element, for example in the form of a button on the outside of the screen. The button is preferably located on the front side of the screen and can, for example, be integrated in a control panel. A mechanical force or an electrical signal can be generated via the button, which force or signal then in each case acts on the locking means and releases the locking device. The button can be a short-stroke key. In this case the button forms a part of the screen that is moved in order to release the retention. With such a button, the force that is required for lifting the locking device, for example releasing a latching connection, is directly produced by the lifting motion of the button. Of course it is also possible, in particular in the case of buttons which have no lifting motion, to use an electrical signal that is generated by the operation of the button to release the locking device. For example a switch can be actuated by the signal. The advantage of the provision of a button for initiating the release process is, in particular, that the user has only to touch the filter element in order to release this from the pivot bearing connection. In this case, further contact with the filter element in order to release the locking device is not necessary.

According to a further embodiment, the releasing device includes the guide for one part of the screen which represents a sliding pull-out drawer. The pull-out drawer can also be termed a pull-out screen. By pull-out drawer is meant the part of the screen which is displaced with respect to the framework of the screen, and in particular, can be withdrawn forwards. Preferably, at least one of the filter elements of the range extractor hood is retained in the pull-out drawer. In addition, at least one further filter element can be retained in the framework of the screen. The guide for the pull-out drawer is formed, in particular, by a lateral support and in the following is therefore also termed a support. The pull-out drawer is retained in the support and can be pushed into it. The support is provided on the framework of the screen or forms a part of the side walls of the framework. The guide can be used in different ways as part of the releasing device. On the one hand it is possible for the guide itself to be the releasing device. In this case, in addition to the pivot bearing, the filter element is retained in the installed position by resting on a part of the rail. This support can be removed by moving the pull-out drawer in the guide and the filter element is hinged downwards due to gravity. In this embodiment, the guide serves as a releasing device and simultaneously as a locking means. In this case, the different functions of the support are determined only by the different relative positions of the pull-out drawer and thus of the filter element in the pull-out drawer with respect to the guide. In addition, a support can be provided on the pull-out drawer. This support serves as a support for the at least one filter element that is provided in the framework. In particular, the filter element lies in the framework in the operating position of the pull-out drawer in the installed position and is retained in this position by the support. If the pull-out drawer is withdrawn beyond the operating position into a withdrawn position, then the support on the pull-out drawer is moved with respect to the filter element or elements on the framework and the filter element or elements no longer lie on the support in the withdrawn position. As a result, when the pull-out drawer is withdrawn into the withdrawn position, the filter element or elements in the framework are swung into a removal position. Therefore, when the pull-out drawer is withdrawn into the withdrawn position the filter element or elements in the framework and the filter element or elements in the pull-out drawer are simultaneously placed in the removal position.

Alternatively, the guide can be part of the releasing device by providing this with at least one actuating element, such as a switch, a button or a bolt, for example, via which the locking device of the filter element is released. The actuating element is located in the guide so that said actuating element is activated by movement of the pull-out drawer and the locking device is unlocked as a result. In this embodiment, the actuating element can be employed both for releasing the locking device of one or a plurality of filter elements in the pull-out drawer and for releasing the locking device of one or a plurality of filter elements in the framework of the screen. Preferably, the actuating element or elements are located in the front area of the guide. In this arrangement, the actuating means or plurality of means can be actuated by suitable elements in the rear area of the pull-out drawer. The element can be a projection on the pull-out drawer.

Preferably, the release of the retention of the filter element is initiated in a withdrawn position of the pull-out drawer, which is offset from the operating position of the pull-out drawer. The operating position of the pull-out drawer means the position of the pull-out drawer in relation to the framework of the screen in which the range exhaust hood is operated. In this operating position the pull-out drawer can be fully seated in the framework or withdrawn forwards by a certain amount out of the framework. The withdrawn position is offset from this operating position. In particular, when preferably in the withdrawn position, the pull-out screen is withdrawn further out of the framework than in the operating position. In this embodiment, by initiating the releasing process only in the withdrawn position, additional protection is provided against unintentional falling down of the filter element or elements. Moreover, removal of the filter is particularly easy in this embodiment since in the simplest case the user has only to withdraw the pull-out drawer forwards in relation to the operating position and can then release the filter element or elements by releasing the connection by means of the pivot bearing. If the pull-out drawer is located in the withdrawn position, and depending on the embodiment of the releasing device, either an actuating element can be operated or the filter element is displaced in the framework so that the filter element no longer rests on the guide.

At least one filter element is provided on the inventive range extractor hood. The filter element can be an expanded metal filter with an aluminum frame or with a stainless steel facing, for example. So-called edge suction filters can of course also be used. The filter element or elements are preferably placed directly onto the screen. This means that at least one part of the pivot bearing and at least one locking means are provided on the filter element. For filter replacement, the entire filter element with the part of the pivot bearing and the locking means are removed from the screen.

Alternatively, according to one embodiment, it is also possible for the filter element to include a frame on which at least one part of the pivot bearing is provided. The filter material, which for example can be expanded metal, and in the form of a filter cartridge, can be housed in the frame. In this embodiment, in order to change the filter the frame can be left on the range extractor hood and the filter material alone removed from the frame after the filter element is tilted. In this case the filter material can be supported on the frame or inserted into it. In addition to the part of the pivot bearing, which can be a pin for example, the at least one locking means in the form of a latching lug or a magnet, for example, can also be provided on the frame.

According to one embodiment, the range extractor hood has at least one damping means for damping the motion of the pivot bearing. The damping means can be a rotary damper that can be provided directly on the pivot bearing, for example in a seat on the screen. Alternatively, however, the damping means can also include a lever structure in which damping elements in the form of springs can be provided, for example. The lever structure engages the filter element at a distance from the pivot bearing. Due to the presence of a damping means, the filter element can be safely swung out and injury to the user avoided.

According to one embodiment, the releasing device can release at least two filter elements which are retained at two separate parts of the screen, at least partially from the retention. In particular, in this embodiment, in the case of a screen with pull-out drawer, the filter elements on the framework of the screen as well as the filter element on the pull-out drawer, can be released from the installed position.

The inventive range exhaust hood can be a chimney, in particular a wall mounted chimney hood or island chimney hood, an integrated cooker hood, a slimline cooker hood or an extractor cooker hood. The advantage of a slimline cooker hood and an extractor cooker hood, in particular, is that the locking device can be released by displacing the pull-out drawer.

BRIEF DESCRIPTION OF THE DRAWINGS

The invention is described again in more detail below with reference to the attached drawings, where.

DETAILED DESCRIPTION OF EXEMPLARY EMBODIMENTS OF THE PRESENT INVENTION

Figure 1:
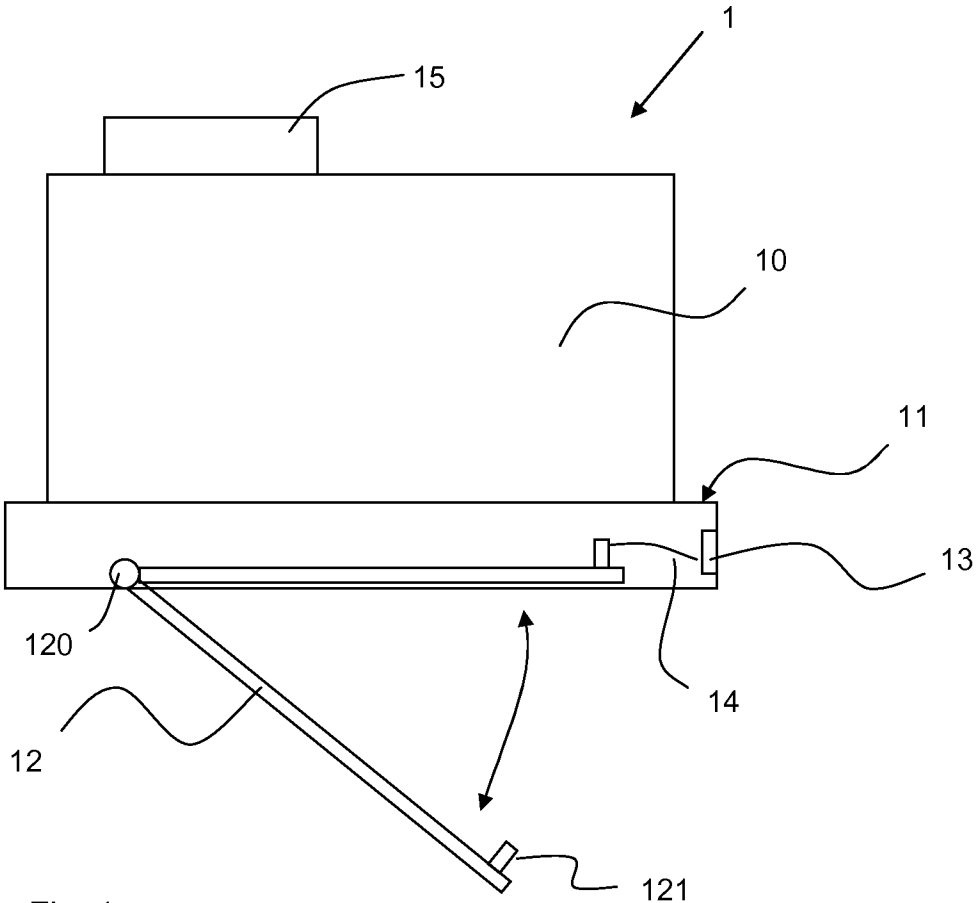
FIG. 1: shows a schematic side view of a first embodiment of the inventive range extractor hood.

FIG. 1 shows schematically an embodiment of the inventive range extractor hood 1. The range extractor hood 1 consists of a housing 10, that in the case of a chimney is also termed a flue, and an adjoining screen 11 underneath the housing 10. On the upper side the housing 10 has an air outlet 15. A fan (not shown) is mounted in the housing 10. A filter element 12 is mounted in the screen 11. In FIG. 1 only one filter element 12 is visible. However, a plurality of filter elements 12 can be provided and arranged alongside each other. The filter element 12 is located horizontally in the installed position. For improved clarity, the elements located in the screen 11 are not drawn with dashed lines. At its rear end the filter element 12 is attached to the screen 11 via a pivot bearing 120. At the front side the filter element 12 is attached to the screen 11 by an upwards oriented locking means 121.

In the first embodiment shown, an operating element 13 via which a releasing device 14 can be actuated, is provided in the front side of the screen 11. The operating element 13 is considered to be part of the releasing device 14. By actuating the operating element 13, which can be a button, for example, the connection in the form of the locking means 121, between the filter element 12 and the screen 11, can be released via the releasing device 14. In the embodiment shown the releasing device 14 can be a mechanical connection between the operating element 13 and the locking means 121 in the installed position of the filter element 12. If the locking means 121 is a latching lug, for example, then the releasing device 14 can act on the latching lug until this disengages from the latching recess in the screen 11.

By releasing the locking device, the filter element 12 is brought into the withdrawn position, also shown in FIG. 1. For this, the filter element 12 is swung downwards about the pivot bearing 120. Preferably, the filter element 12 is retained in this withdrawn position by a stop on the pivot bearing 120, for example. The motion of the filter element 12 from the installed position to the withdrawn position can be damped by one or a plurality of damping means (not shown). In the withdrawn position the user can easily access the filter element 12 and remove it from the screen 11 by removing the connection formed by the pivot bearing 120, for example by levering it out.

Figure 2:
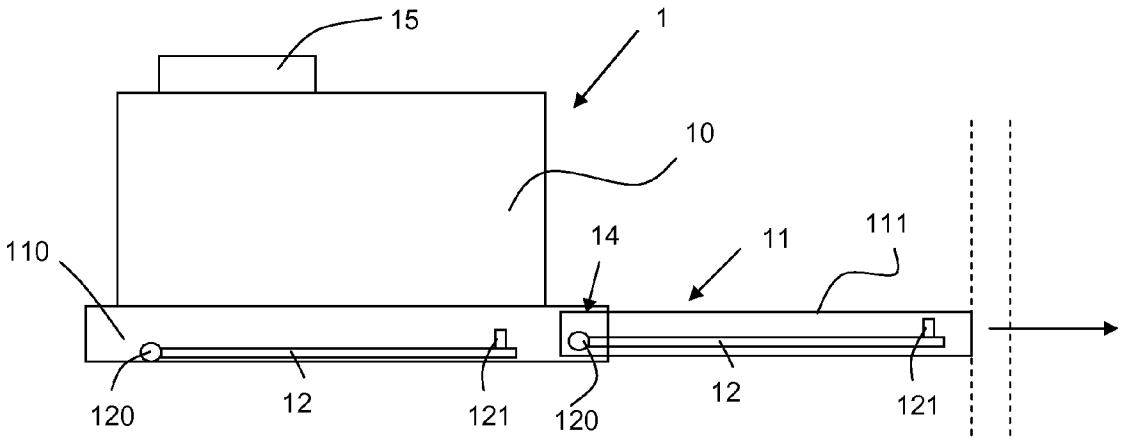
FIG. 2: shows a schematic side view of a second embodiment of the inventive range extractor hood in an operating position.
Figure 3:
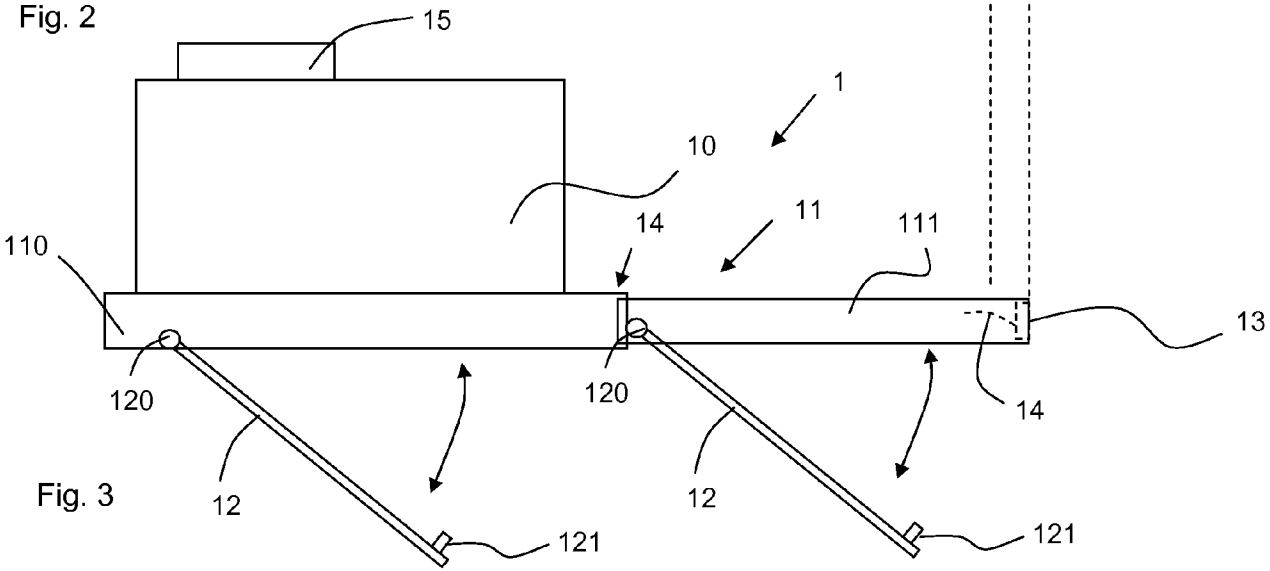
FIG. 3: shows a schematic side view of the second embodiment of the inventive range extractor hood in a withdrawn position.

A second embodiment of the inventive range extractor hood is shown in FIGS. 2 and 3.

The second embodiment differs from the first embodiment in that the screen 11 is embodied in a number of parts. In the second embodiment the screen 11 consists of a framework 110 that is permanently joined to the housing 10, and a pull-out drawer 111 that is attached to the framework 110 in a sliding manner. In particular, the pull-out drawer 111 can be withdrawn forwards in relation to the framework 110. FIG. 2 shows an operating position of the pull-out drawer 111. In this position the pull-out drawer 111 has been withdrawn. Naturally, the rear end of the pull-out drawer 111 is still in the framework 110 of the screen 11. The pull-out drawer 111 is guided in the framework 110 via a guide which, in particular, includes lateral supports. In the embodiment shown, a filter element 12 is indicated in each case in the framework 110 and in the pull-out drawer 111. Preferably of course a plurality of filter elements is arranged side by side, both in the framework 110 as well as in the pull-out drawer 111.

In the operating position of the pull-out drawer 111 the filter elements 12 are located in the installed position, that is to say they are retained in the screen 11 horizontally. The retention system of the filter element 12 corresponds to the retention system of pivot bearing 120 and locking means 121 described in FIG. 1.

In the second embodiment, if the pull-out drawer 111 is withdrawn forwards beyond the operating position, the pull-out drawer 111 is located in the withdrawn position. This is shown in FIG. 3. In this withdrawn position, the filter element 12 is released from its holder by the releasing device 14, which in this case is formed by the guide of the pull-out drawer 111 in the framework 110 or is provided on said framework. Moreover, in the embodiment shown, the releasing device 14 can include a bolt or a switch (not shown), by which the locking device is lifted by the locking means 121 and the filter elements 12 are placed in the withdrawn position shown in FIG. 3.

Alternatively, however, it is also possible for at least the filter element 12 or elements 12 in the pull-out drawer 111 to have no locking means 121 on the front side. In this case the filter element 12 can be retained in the pull-out drawer 111 by the guide of the pull-out drawer 111 in the framework 110 and this acts as the locking means. In such an embodiment, the locking action is canceled merely by the sliding of the pull-out drawer 111 into the withdrawn position. Since the guide on the framework 110 no longer supports the filter element 12 in this position, the filter element 12 swings into the downwards tilted withdrawn position.

Finally, corresponding to the first embodiment, as an alternative it is also possible to provide an operating element 13 on the front side of the pull-out drawer 111. Via the actuation of the operating element 13, a corresponding releasing device 14, which acts on a locking means 121 provided on the filter element 12, can be actuated and the filter element 12 thus placed in the withdrawn position.

The invention is not restricted to the embodiments described. In particular, individual features of one of the embodiments shown can be combined with features of another embodiment and vice versa.

The locking means is not limited to the embodiments as shown. For example, a so-called push-to-open locking system can be employed as the locking means. The push-to-open lock is released by tapping the filter element from underneath and the filter element is swung downwards.

It is possible with the present invention to facilitate filter removal that on the one hand is simple to implement and on the other hand does not require complicated range extractor hood construction.

The present invention is described again with the aid of several possible exemplary embodiments. The filter element, also described as a filter or grease filter, can be hinged open over a definite pivot point. The pivot point can even be integrated in existing parts of the range extractor hood, also described as the appliance, or consist of separate components that are mounted on the range extractor hood or on the filter, respectively. The filter can be removed from the range extractor hood subsequent to the tilting motion. The tilting motion can be damped by an additional damping element in the pivot point. The damping element can be a rotary damper, for example.

The tilting motion is initiated after a filter locking device, which retains the filter in its installed position in the appliance, has been neutralized. For this, according to the invention, it is possible for example to provide a separate button on the appliance, which can be included in a control panel provided on the appliance, or is a separate button from the control panel.

With the present invention a filter change can also be simplified on a range extractor hood having a pull-out drawer. Such range extractor hoods are described as slimline cooker hoods or wall-mounted cooker hoods with pull-out drawer, for example, which are also described as extractor cooker hoods.

In this case, after a sliding locking device has been released, the pull-out drawer of the range extractor hood is pulled out further beyond its installed position in the operating state. This triggers the tilting mechanism for the grease filter, with it being tilted downwards about a pivot point and then being able to be removed. The tilting motion of the filter can be damped with the aid of damping elements in the filter pivot point, for example rotary dampers.

In this case the filters can be immediately released from their installed position after the pull-out drawer is withdrawn beyond the installed position into the withdrawn position, or they initially remain in their installed position and are individually released from their installed position by an additional process for releasing the locking device, for example released via a push-to-open element.

According to the invention the filter element can be realized without a handle. Consequently, from a design point of view the filters can be better matched to the overall appliance.

The present invention has a range of advantages. On the one hand the invention can be utilized for all types of grease filters. Furthermore, the range extractor hood can have different types of construction. In addition, user-friendly filter removal is created by defined positions for removing the filter. Furthermore, rapid and easily understood filter removal and filter mounting is possible. Finally, a visually attractive filter design matched to the appliance is facilitated by the option of a handle-less filter construction.

What is claimed is:

1. A range extractor hood, comprising:

a screen;

at least one filter element supported on the screen;

at least one pivot bearing swingably supporting the at least one filter element on the screen;

at least one locking member operatively associated with the screen and the filter element for retaining the at least one filter element to the screen; and a releasing device located on the screen for, at least partially, releasing the locking member, thereby allowing at least a portion of the filter element to swing downwardly away from the screen, the releasing device being configured for operation without user engagement of the filter element.

2. The range extractor hood of claim 1, wherein the releasing device is actuated by movement of at least one part of the screen.

3. The range extractor hood of claim 1, wherein the releasing device is located, at least partially, at a distance from the locking member.

4. The range extractor hood of claim 1, wherein the releasing device includes an operating element on an outside of the screen.

5. The range extractor hood of claim 1, wherein the releasing device is constructed to provide a guide for one part of the screen constructed in the form of a sliding pull-out drawer.

6. The range extractor hood of claim 5, wherein the pull-out drawer is movable between a withdrawn position in which a release of the retention of the filter element is initiated and an operating position which is offset to the withdrawn position.

7. The range extractor hood of claim 1, wherein the filter element includes a frame on which at least one part of the pivot bearing is provided.

8. The range extractor hood of claim 1, further comprising at least one damper for damping a motion of the pivot bearing.

9. The range extractor hood of claim 1, further comprising at least two of said filter element retained on two separate parts of the screen, said releasing device being configured to release the filter elements at least partially from the retention.

10. The range extractor hood of claim 1, configured as one of a slimline cooker hood and an extractor cooker hood.

* * * * *